US006300031B1

(12) United States Patent
Kato et al.

(10) Patent No.: US 6,300,031 B1
(45) Date of Patent: Oct. 9, 2001

(54) METHOD FOR MANUFACTURING AN ELECTROPHOTOGRAPHIC TONER

(75) Inventors: Hitoshi Kato, Itami; Toshitaro Kohri, Higashiosaka; Hiroyuki Fukuda, Kobe, all of (JP)

(73) Assignee: Minolta Co., Ltd., Osaka (JP)

( * ) Notice: Subject to any disclaimer, the term of this patent is extended or adjusted under 35 U.S.C. 154(b) by 1307 days.

(21) Appl. No.: 08/578,395

(22) Filed: Dec. 22, 1995

Related U.S. Application Data

(63) Continuation of application No. 08/284,102, filed on Aug. 2, 1994, now abandoned.

(30) Foreign Application Priority Data

Aug. 5, 1993 (JP) ..... 5-194656

(51) Int. Cl.[7] ..... G03G 9/08; B02C 19/06
(52) U.S. Cl. ..... 430/137.2; 241/5; 241/29
(58) Field of Search ..... 430/137; 241/5, 241/29, 24.18, 24.28

(56) References Cited

U.S. PATENT DOCUMENTS

| | | | | |
|---|---|---|---|---|
| 4,782,001 | | 11/1988 | Kanda et al. | 430/137 |
| 4,802,977 | | 2/1989 | Kanda et al. | 209/143 |
| 4,844,349 | | 7/1989 | Kanda et al. | 241/19 |
| 4,900,647 | * | 2/1990 | Hikake et al. | 430/137 |
| 4,990,427 | * | 2/1991 | Kohri et al. | 430/110 |
| 5,111,998 | * | 5/1992 | Kanda et al. | 430/137 |
| 5,147,753 | * | 9/1992 | Hikake | 430/137 |
| 5,376,493 | * | 12/1994 | Kobayashi | 430/137 |

FOREIGN PATENT DOCUMENTS

| | | | | |
|---|---|---|---|---|
| 60-140263 | * | 7/1985 | (JP) | 430/137 |
| 63-45590 | | 9/1988 | (JP) . | |

OTHER PUBLICATIONS

Diamond, Arthur S., ed., *Handbook of Imaging Materials*, New York: Marcel–Dekker, Inc., 1991, p. 195.*

Manual for "Turboplex classifier" by Hosokawa Micron Corporation, pp. 128–134 (12/92).

* cited by examiner

*Primary Examiner*—Christopher Rodee
(74) *Attorney, Agent, or Firm*—Burns, Doane, Swecker & Mathis, LLP

(57) ABSTRACT

A method for manufacturing an electrophotographic toner having a mean particle diameter of more than 5 μm and less than 10 μm. For manufacturing the above size of toner, coarsely pulverized particles are pulverized to medium pulverized particles having a mean particle diameter of more than 10 μm and not more than 19 μm at first. Subsequently, the medium pulverized particles are further pulverized to small diameter particles having a mean particle diameter of more than 5 μm and less than 10 μm, and thereafter the small diameter particles are classified by a rotor type classifier.

16 Claims, 2 Drawing Sheets

METHOD FOR MANUFACTURING AN ELECTROPHOTOGRAPHIC TONER

This application is a continuation, of Application Ser. No. 08/284,102, filed Aug. 2, 1994 now abandoned.

BACKGROUND OF THE INVENTION

1. Field of the Invention

The present invention relates to a method for manufacturing toner used in image formation by electrophotographic method.

2. Description of the Related Art

Generally, a toner used for image formation by electrophotographic method is obtained in the manner described below. Firstly, coloring agent, bonding resin, and other additives are mixed and kneaded. Then, the kneaded material is coarsely pulverized, subsequently finely pulverized, and finally classified.

Various means for finely pulverizing the material which has been coarsely pulverized are well known. Examples such means are crushing machines which pulverize via a mesh and cutter that rotates at high speed, hammer mills and turbo mills which shear via the spacing of a liner and a hammer that rotates at high speed, pin mills which shear via the high speed rotation of pins that protrude onto a disk, kryptron pulverizers which shear and pulverize by friction between a large rotor and a liner, jet mills which pulverize by impingement on an impact plate via jet air injected in the pulverized material and the like.

Conventionally, when manufacturing toner having, for example, a mean particle diameter of about 12~15 $\mu$m, a jet airflow type pulverizer is used to finely pulverize coarsely pulverized material to desired small-diameter particles without any step.

On the other hand, today ever finer particle diameter toner is needed to produce a copy image of high image quality. Certain disadvantages arise, as described hereinafter, when the previously mentioned methods and apparatus are used to manufacture fine diameter particles having a mean particle diameter of 10 $\mu$m or less and said toner is used, for example, in a two-component developer comprising a toner and a carrier.

When toner manufactured by the previously mentioned methods and apparatus is used as, a two-component developer, fine powdered toner (binder resin, charge controlling agent and the like) resulting from excessive pulverization becomes mixed in said developer. In developing devices using a two-component developer, the toner is charged by mixing and stirring the carrier and toner. During this mixing and stirring, the aforesaid fine powder toner adheres to the surface of the carrier. The adhesion of this fine powder toner is disadvantageous inasmuch as it causes deterioration of carrier chargeability, and interferes with durability of the developer.

In general, toner having a small particle diameter has a high probability of contact with other toner particles (surface area), thereby causing a further disadvantage of reduced heat resistance due to diminished flow characteristics.

When ultra pulverization produces a mean particle diameter of 10 $\mu$m or less, the spread of particle distribution increases, thereby producing a plurality of fine polar particles. These fine polar particles may electrostatically adhere to the surface of the toner particles having a particle diameter of 10 $\mu$m, and readily remain on the product even after air classification. These residual fine polar particles readily cause of a further disadvantage of fog phenomenon during image formation.

Furthermore, when fine particle toner having a mean particle diameter of 10 $\mu$m or less is manufactured via the aforesaid methods and apparatus, much energy is required to achieve such a degree of pulverization, thereby diminishing production capacity, and ultimately increasing the cost of the product.

SUMMARY OF THE INVENTION

A main object of the present invention is to provide an electrophotographic toner manufacturing method capable of manufacturing high quality fine diameter toner particles.

Another object of the present invention is to provide an electrophotographic toner manufacturing method capable of efficiently producing toner of small particle diameter which does not produce fog or the like during image formation, and which has excellent chargeability, durability, and flow characteristics.

These objects of the present invention are achieved by providing the manufacturing method described below.

A method for manufacturing are electrophotographic toner comprising:

- producing medium pulverized particles from coarsely pulverized particles;
- producing small diameter particles from said medium pulverized particles; and
- classifying said small diameter particles by means of a rotor type classifier.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The embodiments of the present invention mix and knead coloring agents, bonding resins, and other desired additive agents, to produce a kneaded material which is subsequently coarsely pulverized in a convenient pulverization process to produce coarsely pulverized particles having a weight-average particle diameter (hereinafter referred to as "mean particle diameter") of more than 0.5 mm and not more than 5 mm.

The thus obtained coarse pulverized particles are further pulverized to produce particles having a mean particle diameter of more than 10 $\mu$m and not more than 19 $\mu$m (hereinafter referred to as "medium pulverized particles").

Pulverization is accomplished by means of an impact pulverization method, and preferably by means of a high velocity air impact pulverization method. The high velocity air impact pulverization method is a pulverization method using a vortex airflow generated medially to peripheral liners via the high speed rotation of a rotor or the like. While it is possible to accomplish this process by jet pulverization using an ultra high velocity airflow from a jet nozzle, power consumption is markedly higher than an impact pulverization method, and said jet pulverization does not conform to the object of the present invention of improving production capacity. In particular, medium pulverized particles can be formed with excellent efficiency by high velocity air impact pulverization.

The toner of the final product obtained through the previously described medium pulverized particle forming process has excellent chargeability, durability, heat resistance, and flow characteristics.

Although conventional impact type pulverizers may be used as the pulverizer for forming the medium pulverized particles, use of a kryptron system, (Kawasaki Heavy Industries, Ltd.) using a high velocity air impact pulverization method is desirable.

Figure 1:
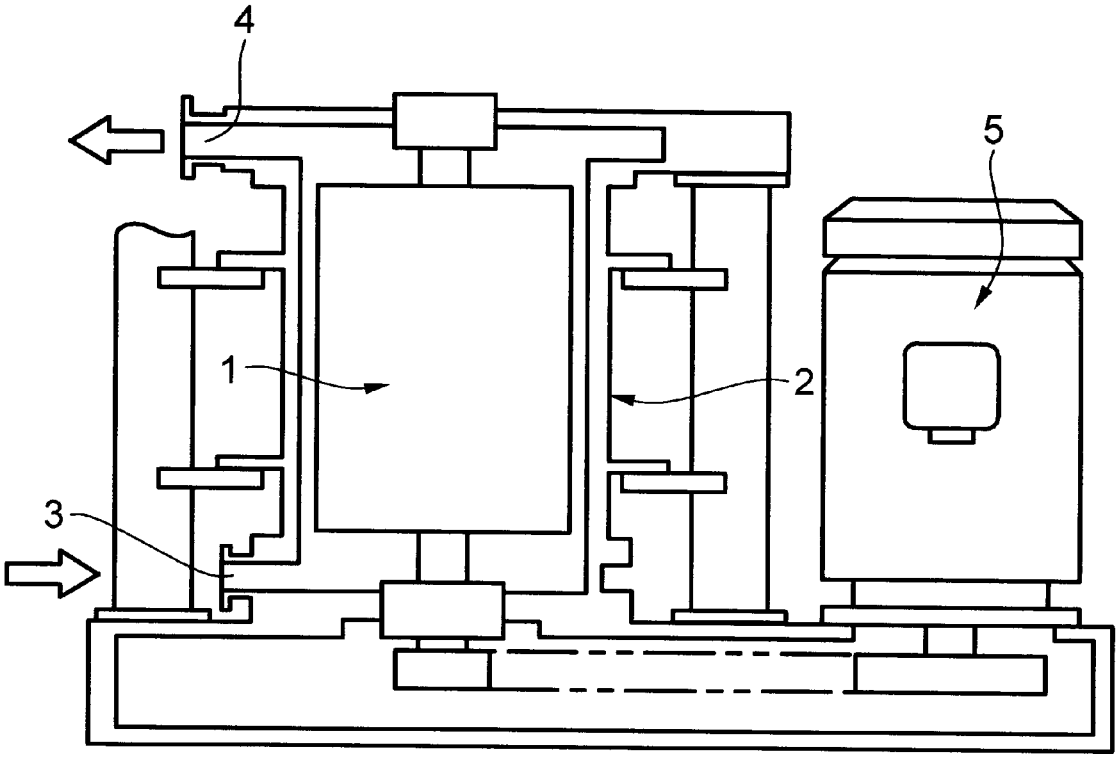
FIG. 1 is a brief construction view showing an example of a high velocity air impact pulverizer.

FIG. 1 is a brief construction view showing the kryptron system. The rotating portion comprises a rotor (1) provided with a plurality of channels, and the casing has a stator mounted thereon provided with a plurality of channels on the interior surface. A strong vortex and pressure oscillation are generated within the apparatus by the high speed rotation of rotor 1. The raw materials are supplied to the pulverization chamber by an suction airflow via a suction aperture (3) in conjunction with said airflow. Then, the material is pulverized by means of the strong airflow vortex, lifted along the rotor in conjunction with the rotation, and discharged together with the airflow via a discharge aperture (4).

The aforesaid apparatus is capable of simultaneously pulverizing coarsely pulverized particles, and strongly immobilizing, via the mechanical impact force, the ultra fine particles of the additive organic or inorganic particles bonded to the surface of the produced medium pulverized particles.

Thus, the organic or inorganic fine particles are strongly bonded to the surface of the obtained medium pulverized particles, such that only a slight percentage of said ultra fine particles are contained among the particles.

Then, the thus obtained medium pulverized particles are further pulverized by means of a jet airflow pulverization method to produce small diameter particles having a mean particle diameter of more than 5 $\mu$m and less than 10 $\mu$m. The jet airflow pulverization method may be a method wherein particles are accelerated by high velocity airflow and caused to strike an impact plate, or a method wherein particles are pulverized by striking other similar particles.

When the manufacturing process is accomplished by using an impact pulverization method on medium pulverized particles, and a jet airflow type pulverization method on small diameter particles, production capacity is greatly improved compared to manufacturing by the impact pulverization method alone or the jet airflow pulverization method alone in processing from the coarsely pulverized particles to the small diameter particles without passing through the manufacturing process for medium pulverized particles.

The jet airflow type pulverization method may be accomplished using the same pulverizer as conventional jet airflow type pulverizers. Examples of such pulverizers are a jet pulverizer (model I Jet Mill; Nippon Pneumatic Mfg. Co., Ltd.), and counter jet mill (Hosokawa Micron Corporation).

Finally, the small diameter particles obtained in the manner described above are classified. Classification is accomplished by a rotor-type classifying device. Classification can produce a toner which possesses improved chargeability, printing resistance (durability), heat resistance, flow characteristics, and environmental qualities. Via the impact force of the particles on the classification rotor, the classification process can smooth the surface of the particles, or render them spherical in shape, further the ultra fine particles having a mean particle diameter of less than 1 $\mu$m strongly adhere to the surface of the toner and to be embedded therein, thereby reducing the amount of free ultra fine particles; classification efficiency is improved by the dispersion effect achieved by the impact force of the classification rotor, thereby preventing said ultra fine particles from contaminating the final product toner; and producing a free charge control agent is unnecessary for the same reasons. Similar effectiveness cannot be achieved by conventional air classifiers which classify particles by weight.

Figure 2:
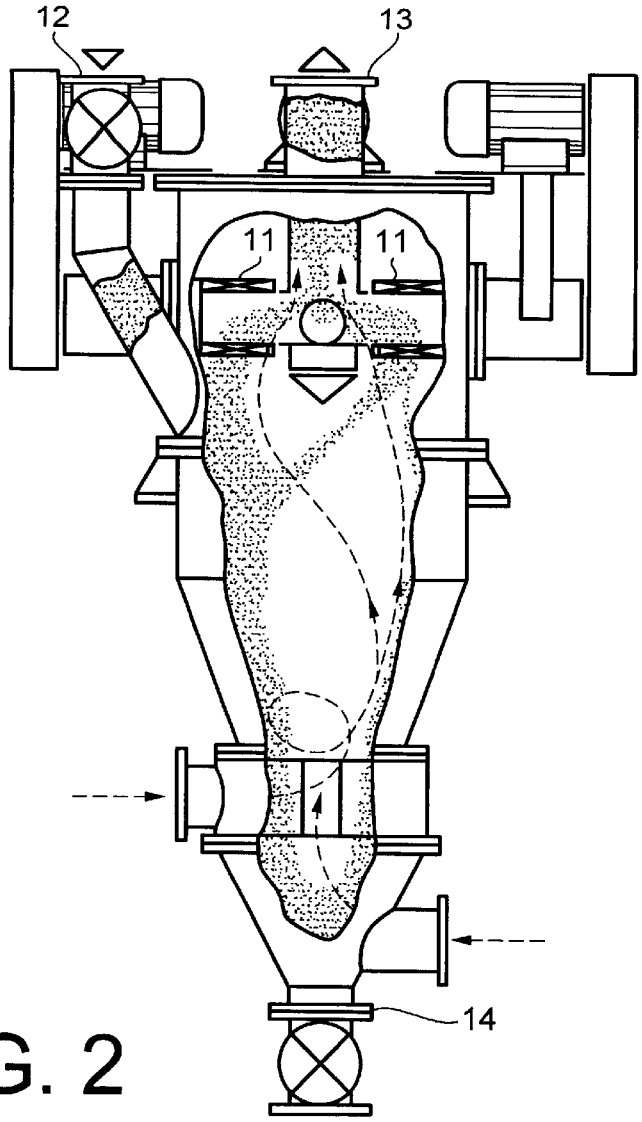
FIG. 2 is a center vertical sectional view showing an example of a rotor type classifier.
Figure 3:
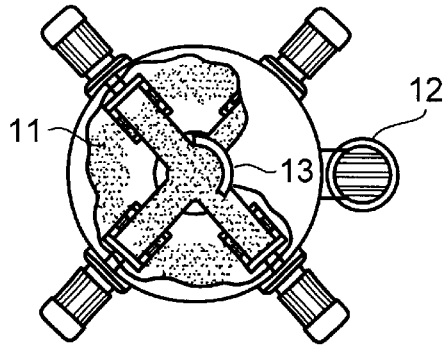
FIG. 3 is a horizontal section view of the classifying section of the rotor type classifier of FIG. 2.

Various types of rotor-type classifiers are known, for example, the Turbo classifier (Nisshin Engineering Co., Ltd.), and Donaselec (Japan Donaldson). Among these classifiers, the Turboplex Ultrafin classifier ATP series 100~1,000 (Hosokawa Micron Corporation) is preferred. The construction of the Turboplex multihole type classifier of the aforesaid classifier series is shown in FIGS. 2 and 3. FIG. 2 is a center vertical sectional view, and FIG. 3 is a horizontal section view of the classification section.

Raw materials (small diameter particles) are loaded from material aperture 12, and is carried into the classification chamber through a rotary valve or together with an indraft airflow, as shown in FIG. 2. The indraft airflow flows, for example, upward from bottom to top as indicated by the arrow within the classifier. The raw materials are lifted in conjunction with the aforesaid airflow and are introduced into classification section 11 where they are classified, and the classified particles are discharged through common fine particle outlet 13. Classification section 11 is provided with a plurality of individual classification rotors mounted horizontally and driven by an individual drive method. A common speed controller is actuated through a single frequency converter. The fast rotational force of these rotors and the indraft airflow cause the particles having less than a predetermined particle diameter to be lifted and discharged through the outlet 13. The classifier incorporates a coarse particle classifier at coarse particle outlet 14, and the coarse particles which are not caused to be lifted drop into the outlet 14. Small diameter particles may be classified by air classifier before being loaded in the rotor-type classifier as a raw material.

The embodiments of the present invention are described hereinafter by way of specific examples.

FIRST EMBODIMENT

Styrene acrylic copolymer resin 100 pbw* (Mn:5,000, Mw/Mn:48 (GPC measurement)

Carbon black 8 pbw (MA#8, Mitsubishi Kasei Kogyo K.K.)

Nigrosine stain 5 pbw (Bontron N-01, Sanyo Kasei Kogyo K.K.)

Low molecular weight polypropylene 2.5 pbw (Viscol 550P, Sanyo Kasei Kogyo K.K>)

*pbw=parts-by-weight

The aforesaid materials are mixed by a high velocity rotary blade type mixer. The obtained mixture is continuously extruded and kneaded by a kneading machine. The kneaded mixture is cooled, and subsequently coarsely pulverized by a hammer mill to produce coarsely pulverized particles having a weight-average particle diameter of 2 mm.

The obtained coarsely pulverized particles are pulverized by a mechanical type impact pulverizer (Kryptron model KTMO, Kawasaki Heavy Industries, Ltd.), to produce medium pulverized particles having a weight-average particle diameter of 11 μm.

The obtained medium pulverized particles are finely pulverized in a closed circuit incorporating a jet pulverizer (I-5, Nippon Pneumatic Mfg. Co., Ltd.) and an airflow classifier (DS-5, Nippon Pneumatic Mfg. Co., Ltd.), to produce small diameter particles.

The obtained small diameter particles are classified under the conditions listed below using a rotor type classifier (Turboplex classifier type ATP100, Hosokawa. Micron Corporation) at 11,500 rpm (rotor speed: 30 m/s), to produce toner particles having a weight-average particle diameter of 8.5 μm. The mean particle diameter of the medium pulverized particles is 1.29 relative to the mean particle diameter of the aforesaid toner particles.

Finally, the obtained toner particles are placed in an additive mixture of 0.2% by weight of hydrophobic silica (R-976, Nippon Aerosil Co., Ltd.), to produce Toner A.

SECOND EMBODIMENT

The small diameter particles obtained in the first embodiment are finely classified by an airflow-type classifier (DS-5UR, Nippon Pneumatic Mfg. Co., Ltd.). Thereafter, these particles were again classified under the same conditions as described in the first embodiment using a rotating blade type classifier to obtain toner particles having a weight-average particle diameter of 8.5 μm. The obtained toner particles are thereafter processed in the same manner as described in the first embodiment to produce Toner B.

THIRD EMBODIMENT

The toner particles obtained in the first embodiment are again classified using a rotating blade type classifier. Although this time the revolutions-per-minute of the blade is the same as in the first embodiment, the classification point is lowered to avoid reducing the product recovery rate. Toner particles having a weight-average particle diameter of 8.5 μm are obtained. The obtained toner particles are thereafter processed in the same way as described in the first embodiment to produce toner C.

FOURTH EMBODIMENT

In the present embodiment, the weight-average particle diameter of the medium pulverized particles is 17 μm compared to the medium pulverized particles in the first embodiment which have a weight-average particle diameter of 11 μm. In other respects the particles of the present embodiment are processed in the same way as the first embodiment to produce toner D having a weight-average particle diameter of 8.5 μm.

REFERENCE EXAMPLE 1

Particles are processed in the same manner as described in the first embodiment with the exception that an airflow type two-stage classifier is used and the rotational blade type classifier of the first embodiment is not used to produce toner HA having a weight-average particle diameter of 8.5 μm.

REFERENCE EXAMPLE 2

Particles are processed in the same manner as described in the first embodiment with the exception that the process for obtaining the medium pulverized particles is omitted to produce toner HB having a weight-average particle diameter of 8.5 μm.

REFERENCE EXAMPLE 3

Particles are processed in the same manner as described in the first embodiment with the exception that an airflow type two-stage classifier is used but the process for producing the medium pulverized particles is omitted and a rotational blade type classifier is not used as in the first embodiment to produce toner HC having a weight-average particle diameter of 8.5 μm.

REFERENCE EXAMPLE 4

Particles are processed in the same manner as described in Reference Example 1 with the exception that 0.4 percent by weight silica additive to produce toner HD having a weight-average particle diameter of 8.5 μm.

REFERENCE EXAMPLE 5

Particles are processed in the same manner as described in the first embodiment with the exception that the medium pulverized particles have a particle diameter of 17.5 μm to produce toner HE having a weight-average particle diameter of 8.5 μm.

REFERENCE EXAMPLE 6

Particles are processed in the same manner as described in the first embodiment with the exception that the medium pulverized particles have a diameter of 8.9 μm to produce toner HF having a weight-average particle diameter of 8.5 μm.

The methods for manufacturing the various toners of the previously described First through fourth Embodiments and Reference Examples 1~6 are shown briefly in Tables 1 and 2.

EVALUATIONS

(1) Production Capacity

When the production capacity of Reference Example 2 is designated 1.0, the production capacities of the various examples are expressed as multiples thereof. The production capacities of the embodiments are defined as the amount of product manufactured per unit time from the pulverization/classification line.

(2) Chargeability

Separately prepared binder type carriers (mean particle diameter 65 μm) and toners were mixed at a mixing ratio of 5 percent by weight. The amount of toner charge when mixed for 3 minutes in a rotating cylinder type mixer was designated Q1, and the amount of toner charge when mixed for 1 hour was designated Q2, to derive the ratio Q1/Q2. The toner evaluation was as follows.

◎:0.85 or greater

○:0.75 to less than 0.85

Δ:0.65 to less than 0.65

X: less than 0.65

The binder type carrier was a mixture of ferrite powder and styrene-acrylic resins which were heat fused, then cooled, and subsequently pulverized and classified.

(3) Print Resistance

The developer comprised the aforesaid binder type carrier (mean particle diameter 65 μm) and toner mixed at a mixing ratio of 5 percent by weight, and mixed for 10 minutes by a rotating cylinder type mixer.

The photosensitive member of a Minolta Camera copier model EP-8600 was modified to a negative charge type organic photosensitive member and used in the copying apparatus.

After making 100,000 copies, toner fog and toner dispersion on the copy sheets were evaluated.

Toner fog was visually evaluated as fog in the white areas per the rankings below.

R-5: completely white

R-4: fog undiscernible visually

R-3: fog not a practical problem

R-2: slight fogging

R-1: unusable

Overall evaluation of toner fog ;and toner dispersion was evaluated per the rankings below.

⊙: R-5, no visible soiling of sheet

○: R-4, visible soiling of sheet undiscernible visually

Δ: R-3, visible soiling of sheet not a practical problem

X: R-2, some soiling of sheet

XX: R-1, severe soiling of sheet (4) Heat Resistance

Into a glass bottle (total size 50 ml, orifice diameter 2 cm) was added 10 g toner, which was stored at 50° C. for 24 hours in a humidistatic chamber. The glass bottle was removed from the humidistatic chamber, and the dischargeability of the toner from the bottle was evaluated per the rankings below.

⊙: After removal from the humidistatic chamber, toner powder flows immediately from the bottle and is smoothly discharged.

○: After shaking the bottle several times, toner flows smoothly from the bottle.

Δ: After vigorous shaking of the bottle, toner flows smoothly from the bottle.

X: Toner clumps remain even after vigorous shaking of the bottle. Toner can be discharged from the bottle.

XX: Toner is blocked, and cannot be discharged from the bottle.

(5) Environmental Qualities

The developer used in the print resistance tyevaluations were used in the environmental qualities evaluation. the amount of toner charge was measured after mixing for 10 hours under conditions of 20° C. and 15% humidity (N/L), and 30° C. and 80% humidity (H/H). Evaluation was accomplished by the rate of change in the amount of charge under condition H/H relative to the amount of charge under condition N/L per the rankings below.

⊙: rate of change less than 10%

○: rate of change from 10% to less than 20%

Δ: rate of change from 20% to less than 30%

X: rate of change 30% or greater (6) Overall Evaluation

The aforesaid evaluations 1~5 were combined per the rankings below.

⊙: no problem at all (all pages ⊙)

○: all pages rated o or better

Δ: more than half the pages rated Δ

X: one sheet has critical defect (X)

XX: two or more sheets have a critical defect (X)

The aforesaid evaluations are shown in Tables 1 and 2.

TABLE 1

| | Embodiment 1 | Embodiment 2 | Embodiment 3 | Embodiment 4 |
|---|---|---|---|---|
| Toner | A | B | C | D |
| Medium | KTMO type | KTMO type | KTMO type | KTMO type |
| Medium diameter | 11 μm | 11 μm | 11 μm | 17 μm |
| Class 1 | Rotation 30 m/s | Airflow | Rotation 30 m/s | Rotation 30 m/s |
| Class 2 | — | Rotation 30 m/s | Rotation 30 m/s | — |
| Toner dia. | 8.5 μm | 8.5 μm | 8.5 μm | 8.5 μm |
| Production capacity | 2.0 | 2.0 | 2.0 | 1.5 |
| Charging | ⊙ | ⊙ | ⊙ | ○ |
| Print resistance | ○ | ⊙ | ⊙ | Δ |
| Heat resistance | ○ | ○ | ⊙ | ○ |
| Flow | ○ | ○ | ⊙ | Δ |
| Environ. | ○ | ○ | ○ | ○ |
| Overall | ○ | ⊙ | ⊙ | ○ |

TABLE 2

| | Ref 1 | Ref 2 | Ref 3 | Ref 4 | Ref 5 | Ref 6 |
|---|---|---|---|---|---|---|
| Toner | HA | HB | HC | HD | HE | HF |
| Medium | KTMO | none | none | KTMO | KTMO | KTMO |
| medium dia. | 11 μm | — | — | 11 μm | 17.5 μm | 8.9 μm |
| Cl. 1 | air | rotate 30 m/s | air | air | rotate 30 m/s | rotate 30 m/s |
| Cl. 2 | air | none | air | air | none | none |
| Toner dia. | 8.5 μm | 8.5 μm | 8.5 μm | 8.5 μm | 8.5 μm | 8.5 μm |
| Prod. | 2.0 | 1.0 | 1.0 | 2.0 | 1.5 | 0.7 |
| Charge | Δ | Δ | X | Δ | ○ | ○ |
| Print | Δ | X | X | X | Δ | ○ |
| Heat | X | X | XX | ○ | Δ | ○ |
| Flow | Δ | X | XX | ○ | Δ | ○ |
| Envir. | ○ | ○ | ○ | X | ○ | ○ |
| Over-all | X | X | XX | X | Δ~X | X |

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A method for manufacturing an electrophotographic toner comprising:

producing medium pulverized particles from coarsely pulverized particles by high velocity air impact pulverization which includes using a vortex airflow generated medially to peripheral liners via high speed rotation of a rotor;

producing small diameter particles from said medium pulverized particles by jet airflow pulverization which includes accelerating particles by high velocity airflow which causes the particles to strike an impact plate or other particles; and classifying said small diameter particles by means of a classifier which has at least one rotor so as to produce an impact force against the particles.

2. A method as claimed in claim 1 wherein said coarsely pulverized particles have a mean particle diameter of more than 0.5 mm and not more than 5 mm.

3. A method as claimed in claim 1 wherein said medium pulverized particles have a mean particle diameter of more than 10 μm and not more than 19 μm.

4. A method as claimed in claim 1 wherein said small diameter particles have a mean particle diameter of more than 5 μm and less than 10 μm.

5. A method as claimed in claim 1 wherein said classifying smooths the surface of the small diameter particles.

6. A method as claimed in claim 1 wherein said classifier comprises a classification chamber, a material aperture through which raw materials are loaded into the classification chamber, and classification section into which the raw materials lifted by an indraft airflow in the classification chamber are introduced to be classified therein, said classification section provided with a plurality of classification rotors mounted horizontally and driven individually.

7. A method for manufacturing an electrophotographic toner comprising:

producing medium pulverized particles having a mean particle diameter of more than 10 μm and not more than 19 μm from coarsely pulverized particles by high velocity air impact pulverization which includes using a vortex airflow generated medially to peripheral liners via high spend rotation of a rotor;

producing small diameter particles having a mean particle diameter of more than 5 μm and less than 10 μm from said medium pulverized particles by jet airflow pulverization which includes accelerating particles by high velocity airflow which causes the particles to strike an impact plate or other particles; and classifying said small diameter particles while removing ultra fine particles from said small diameter particles by means of a classifier which has at least one rotor so as to produce an impact force against the particles.

8. A method as claimed in claim 7 wherein said coarsely pulverized particles have a mean particle diameter of more than 0.5 mm and not more than 5 mm.

9. A method as claimed in claim 7 wherein said classifier comprises a classification chamber, a material aperture through which raw materials are loaded into the classification chambers and classification section into which the raw materials lifted by an indraft airflow in the classification chamber are introduced to be classified therein, said classification section provided with a plurality of classification rotors mounted horizontally and driven individually.

10. A method as claimed in claim 9 wherein said ultra fine particles strongly adhere to the surface of the toner and are embedded in the toner surface via the impact force against the particles produced by said classification rotors.

11. A method as claimed in claim 9 wherein the driven rotors of the classifier smooth the surface of the small diameter particles via the impact force against the particles.

12. A method as claimed in claim 7, wherein said ultra fine particles has a mean particle diameter less than 1 μm.

13. A method for manufacturing an electrophotographic toner comprising:

producing medium pulverized particles having a mean particle diameter of more than 10 μm and not more than 19 μm from coarsely pulverized particles by high velocity air impact pulverization which includes using a vortex airflow generated medially to peripheral liners via high speed rotation of a rotor;

producing small diameter particles having a mean particle diameter of more than 5 μm and less than 10 μm from said medium pulverized particles by jet airflow pulverization which includes accelerating particles by high velocity airflow which causes the particles to strike an impact plate or other particles;

loading said small diameter particles into a classification chamber of a classifier wherein the small diameter particles are lifted by an indraft airflow in the classification chamber;

introducing the lifted small diameter particles into a classification section of the classifier, said classification section provided with a plurality of classification rotors so as to produce an impact force against the particles; and driving the plurality of classification rotors so that the small diameter particles are classified in the classification section via the fast rotational force of the rotors and indraft airflow in the classification chamber.

14. A method as claimed in claim 13 wherein the classification rotors are mounted horizontally and driven individually.

15. A method as claimed in claim 13 wherein ultra fine particles having a mean particle diameter of less than 1 μm strongly adhere to the surface of the toner and are embedded in the toner surface via the impact force against the particles produced by said classification rotors upon the driving of the plurality of classification rotors.

16. A method as claimed in claim 13 wherein said classification rotors smooth the surface of the small diameter particles via the impact force of the particles thereon.

* * * * *